US006742919B2

(12) United States Patent
Tiesler-Wittig

(10) Patent No.: US 6,742,919 B2
(45) Date of Patent: Jun. 1, 2004

(54) DISCHARGE LAMP AND HEADLIGHT FOR A MOTOR VEHICLE

(75) Inventor: Helmut Tiesler-Wittig, Tokyo (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 65 days.

(21) Appl. No.: 10/208,670

(22) Filed: Jul. 30, 2002

(65) Prior Publication Data

US 2003/0031026 A1 Feb. 13, 2003

(30) Foreign Application Priority Data

Aug. 2, 2001 (DE) ..... 101 37 837

(51) Int. Cl.[7] ..... F21V 17/02
(52) U.S. Cl. ..... 362/512; 362/521; 362/263
(58) Field of Search ..... 362/512, 281, 362/319, 521, 263, 227, 508, 464, 538, 539; 313/110, 111, 113, 116

(56) References Cited

U.S. PATENT DOCUMENTS 5,646,471 A * 7/1997 Scholler et al. ..... 313/25
6,286,985 B1 * 9/2001 Ohshio et al. ..... 362/512

* cited by examiner

*Primary Examiner*—Stephen Husar
*Assistant Examiner*—Bao Q Truong

(57) ABSTRACT

A discharge lamp and a headlight for a motor vehicle are proposed. A moving member is provided, which is movable between at least two positions, for switching over between different light distributions. It comprises at least one optically active element, preferably a lens, which generates an image of the gas discharge which is shifted away from the actual location thereof. A switch-over between two different light distributions is made possible by a movement of the moving member between the two positions in the headlight, such that the gas discharge seems to be shifted by the switch-over for a respective region of the reflector, whereby different light distributions are created. Preferably, the moving member is the outer bulb of the discharge lamp, on which two lenses are arranged and which is rotatable about the optical axis.

9 Claims, 4 Drawing Sheets

DISCHARGE LAMP AND HEADLIGHT FOR A MOTOR VEHICLE

The invention relates to a discharge lamp and to a headlight for a motor vehicle.

Besides the incandescent lamps which have been used for a long time in automobile application, discharge lamps are also increasingly used for motor vehicle lighting. A gas discharge which emits a very intensive light is generated in a closed discharge vessel between two electrodes in known discharge lamps.

A discharge lamp usually comprises a lamp base, a burner comprising a discharge vessel, and an outer bulb. The lamp base serves to retain the burner and to position the lamp and contact it electrically in a headlight. The actual light generation takes place in the discharge vessel. Usually, an outer bulb of glass is arranged around the discharge vessel. This bulb serves to filter out UV radiation from the emitted light.

A motor vehicle headlight comprises a reflector and a lamp projecting through an opening into the interior of the reflector. The lamp is exactly positioned with its lamp base in a holder of the reflector, so that the discharge vessel is arranged in an exactly defined location. The reflector surface is illuminated by the emitted light. A headlight beam is formed thereby which, depending on the shape of the reflector surface, is radiated in forward direction. Various specifications exist for such headlight beams, depending on the lighting function to be performed. Thus a low beam, for example, must exhibit an asymmetrical light distribution with a substantially horizontally sharply delimited bright/dark cut-off, so that oncoming traffic is not dazzled. In a high beam, on the other hand, the maximum light intensity should be concentrated on the optical axis, while the remaining light distribution may be approximately symmetrical, and there is no bright/dark cut-off.

Although the discharge lamp has a number of advantages over conventional halogen lamps, it is considerably more difficult in a discharge lamp, as compared, for example, with known H4 lamps, for one lamp or one headlight with one lamp to be able to fulfill two lighting functions at the same time.

Thus DE-A-4435507 describes a headlight with a reflector and a light source which is arranged in a lamp holder, which lamp holder can be pivoted relative to the reflector by means of an adjustment element about a horizontal axis between a position for the low beam and a position for the high beam. In addition, movable screens are shown, which screens move during the pivoting movement from the low-beam to the high-beam position such that a lower region of the reflector, which is cut off in the low-beam position, is illuminated in the high-beam position.

DE-A-19825375 describes a headlight with a gas discharge lamp for motor vehicles, which headlight can be screened and unscreened. The gas discharge lamp is incorporated in a fixed position in the reflector housing of the reflector. A polarizing filter, which can be made transparent and opaque so as to serve as the control adjustment member, is arranged in the reflector housing such that a switch-over can be made between the low-beam and high-beam functions.

EP-A-0324652 describes an automobile headlight with a parabolic reflector and a gas discharge lamp. The gas discharge lamp is positioned in the focus of the reflector. To switch over between high beam and low beam, the light arc of the lamp is deflected through the generation of an electric or magnetic field such that a high beam is generated in conjunction with the reflector and the light arc in a first position, and a low beam in another position.

GB-A-2216332 describes a headlight for an automobile in which a gas discharge lamp is arranged inside a reflector. The gas discharge lamp generates a very concentrated light at its cathode. The location of the light generation is switched over between the electrodes arranged at a distance from one another through a change in the polarity, so that a low beam or a high beam is generated owing to different reflections on the reflector.

The existing solutions have a few practical disadvantages. In the case of a mechanical movement of the burner, it is very complicated to achieve the necessary exact positioning inside the reflector. The other solutions also proved to be complicated and not satisfactory in all cases.

Against this background, it is an object of the invention to provide a lamp and a headlight for a motor vehicle in which a switch-over between two lighting functions takes place in a simple manner, while nevertheless an exact positioning of the discharge vessel is maintained.

This object is achieved by means of a discharge lamp as claimed in claim 1 and a headlight as claimed in claim 6. Dependent claims relate to advantageous embodiments of the invention.

According to the invention, a moving member comprising at least one optically active element is provided at the lamp. The moving member is movably provided at the lamp, so that it can assume at least two different positions with respect to the discharge vessel.

The moving member comprises at least one optically active element. Preferred elements which may be used are lenses, but, for example, also prisms or mirrors, in particular concave mirrors. The optically active element generates an image of the gas discharge in the discharge vessel which is shifted with respect to the actual location of the gas discharge. The result of this is that the gas discharge seems to be shifted when observed from a location optically situated behind the optically active element.

The moving member is movable between at least two positions, so that it can be actively controlled whether from a given direction the discharge vessel with the discharge taking place therein is directly visible, or the shifted image thereof is visible through the optically active element.

A headlight according to the invention comprises a reflector and a lamp with a moving member. A certain region of the reflector is illuminated, in dependence on the position of the moving member, either directly by the gas discharge or indirectly through the optically active element, i.e. by the shifted image of the discharge generated by the element. The discharge vessel appears to be in its actual position or in a shifted position viewed from this region of the reflector, in dependence on the position of the moving member.

A movement of the actual light-generating element, i.e. the discharge vessel, is not necessary with the lamp according to the invention and the headlight according to the invention. The discharge vessel and the entire burner can indeed remain in place, which is advantageous in particular in respect of their fixed retention, exact positioning, and electrical connection. The moving member may be directly attached to the lamp, for example to the lamp base. It is alternatively possible, however, to arrange the moving member separately in the reflector.

The invention achieves the effect that the light-generating discharge vessel is seemingly switched between two positions, depending on the position of the moving member, for at least certain reflector regions. As is known from the cited prior art and also from conventional H4 lamps, two lighting functions can be realized with one reflector through shifting of the light-generating element. It is known in detail to those skilled in the art how a displacement of the light source influences a light beam emitted by a reflector. This effect is utilized, for example, with dual-filament incandescent lamps (for example H4), in which two different light beams are generated with one reflector and two coils arranged at a small distance from one another, such that two lighting functions are performed. With a parabolic reflector, for example, a slight displacement from the focus in forward and upward direction leads to a distribution which causes a low-beam distribution shifted in downward direction with respect to the parallel light beam. The shifting of the light source in conjunction with specially designed "independent surface" or "complex shape" reflector surfaces, whose shapes are digitally determined for the relevant application, renders it possible to generate two different light beams whose requirements are each defined beforehand and are taken into account in the design of the surfaces.

In a further embodiment of the invention, it is proposed that the moving member is a sleeve of a transparent material which surrounds the discharge vessel. In a particularly advantageous embodiment, this sleeve is the outer bulb of the discharge vessel. Said outer bulb, which has served mainly as a UV filter until now, is fixedly connected to the discharge vessel in conventional applications, usually by fusion. This, however, is not necessarily the case. This is why the outer bulb may be used as the moving member.

The outer bulb is usually arranged longitudinally with respect to the optical axis. It may be axially shifted when serving as the moving member. It is preferred, however, that the moving member is capable of rotation, in particular about the optical axis. A satisfactory support and an exact positioning are easy to achieve in that case. The operation may be realized in various ways. The use of mechanical adjustment drives as well as a direct drive by an electric motor is possible. Piezoactuators and the use of electromagnets are also conceivable.

In an advantageous embodiment, the optically active element is provided at the outer bulb. Preferably, there are two optical elements which are provided at mutually opposed sides of the outer bulb and which are active in a plane perpendicular to the optical axis on which the light source is situated, each over an angular range of 25 to 120°, preferably approximately 60 to 90°.

Lenses are preferred as the optically active elements, which lenses are formed such that they cause the gas discharge to appear to be displaced, preferably in the direction of the optical axis, when viewed through the lens. Suitable lenses may be readily designed by those skilled in the art for the respective applications.

An embodiment of the invention will now be explained in more detail below with reference to drawings, in which:

FIG. 1 is a side elevation of an embodiment of a lamp according to the invention with a moving member in a first position;

FIG. 1*a* is a side elevation of the lamp of FIG. 1 with the moving member in a second position;

FIG. 2 is a front elevation of the lamp of FIG. 1;

FIG. 2*a* is a front elevation of the lamp of FIG. 1*a* with the moving member in the second position;

Figure 1:
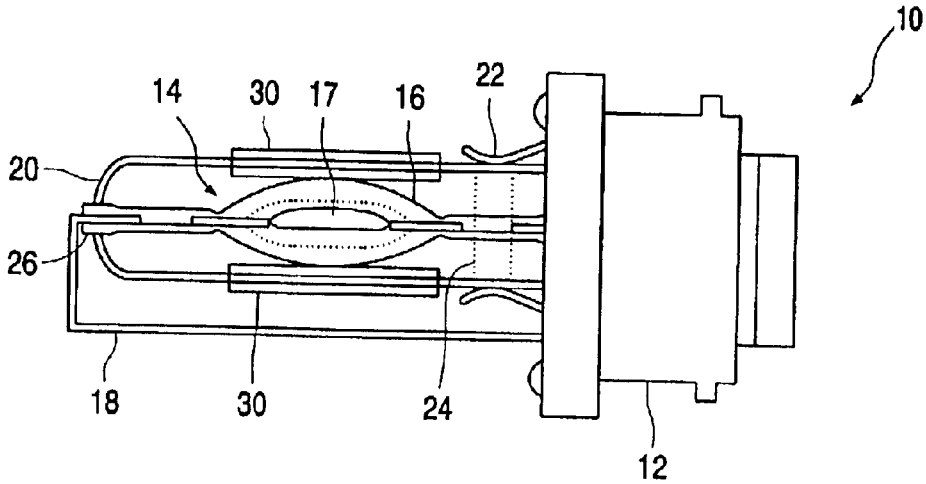

FIG. 1 shows a discharge lamp 10. The discharge lamp 10 comprises a lamp base 12, a burner 14 with a discharge vessel 16, and a return supply lead 18.

The lamp base 12 has electrical contacts which are connected to the electrodes of the discharge vessel 16 via a lead-through and the return supply lead 18. A discharge can thus be generated within the discharge vessel 16. Such discharge lamps are known in various embodiments to those skilled in the art, so that the known construction and operation thereof will not be discussed in any detail here.

The discharge lamp 10 has an outer bulb 20 around the burner 14. This bulb is a glass tube with an inner diameter which is only slightly greater than the outer diameter of the discharge vessel 16. In the present case, the discharge vessel, which is oval in longitudinal sectional view, has a greatest outer diameter of 6 mm. The outer bulb 20 has an outer diameter of 8.7 mm and a wall thickness of approximately 1 mm. The glass of the outer bulb is doped in a manner known to those skilled in the art, so that it safeguards a satisfactory UV absorption.

The outer bulb 20 is fastened to the lamp base 12 by means of strips 22 which are fastened to a sleeve 24. The outer bulb 20 can be rotated with respect to the lamp base 12 about an axis of rotation which coincides with the longitudinal central axis of the lamp 10. For this purpose, the strips 22 are provided on a ring (not shown) which is journaled so as to rotate inside the lamp base 12. Rotation of the ring will rotate the outer bulb 20 about the burner 14. The outer bulb 20 is also supported at its tip 26 against the glass tube of the burner 14 with rotation possibility.

Two lenses 30 are arranged at the outer walls of the outer bulb 20. These lenses are indicated symbolically only in the embodiment shown, i.e. their optically active curvature is not shown in FIG. 1. The lenses may be arranged as separate elements on the outer wall of the outer bulb 20, as in the example shown, or they may be integral with the outer bulb 20 through a variation of the wall thickness thereof.

Figure 2:
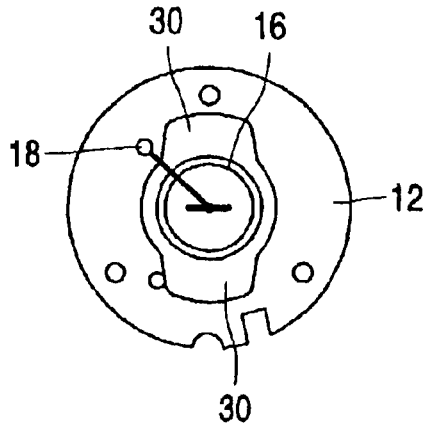

FIG. 2 shows the lamp of FIG. 1 in front elevation. It is apparent that the lenses 30 are arranged above and below the discharge vessel 16, each being optically active in a plane perpendicular to the optical axis or longitudinal central axis of the lamp 10 in an angular range having a width of approximately 90° above as well as below the discharge vessel. The position of the outer bulb 20 shown in FIG. 1 and FIG. 2, where the lenses 30 are arranged above and below the discharge vessel 16, will be denoted the "first position" hereinafter.

Figure 1A:
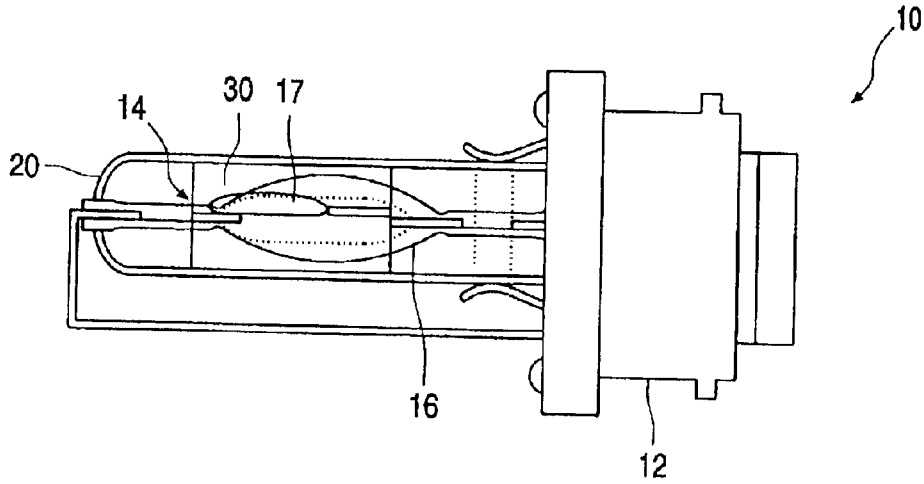
Figure 2A:
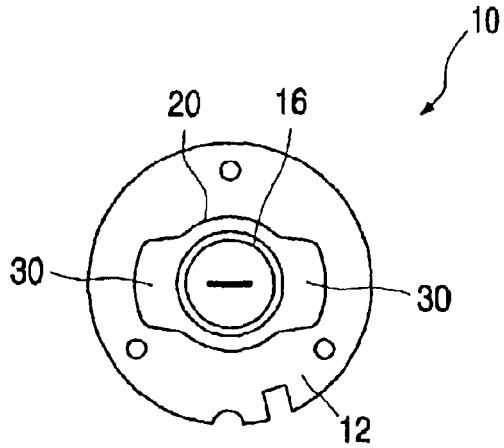

By contrast, the FIGS. 1*a* and 2*a* show the lamp 10 again, but now with the outer bulb 20 in a second position. The outer bulb 20 is rotated through 90° in the second position as compared with the first position. The remainder of the lamp, with the lamp base 12 and the burner 14, however, is in the same position as in FIG. 1.

In the side elevation shown in FIGS. 1 and 1*a*, no lens is in front of the discharge vessel in FIG. 1. In the second position shown in FIG. 1*a*, however, one of the lenses 30 is now in front of the discharge vessel 16, seen from this viewpoint, so that the lens is optically active when the discharge 17 is viewed from this direction. As is shown in FIG. 1*a*, the lens 30 operates in a manner such that the discharge 17, which is actually still present in the original location shown in FIG. 1, seems to be shifted in forward and upward direction with respect to the optical axis.

The second position of the outer bulb 20, in which the lenses 30 are arranged laterally of the discharge vessel 16 to the right and to the left, is also visible in FIG. 2*a*. The lamp base 12 with the retaining grooves for an exact positioning in a holder is still in the same position as in FIG. 2. The outer bulb 20 has been rotated through 90° with respect to FIG. 2 through rotation of the rotary ring (not shown) inside the lamp base 12.

The lamp 10 thus has the lenses 30 as the optically active elements, which are active each in an approximately 90° wide angular region in the first position, above and below the discharge 17, so that the discharge 17 appears to be shifted when viewed from these directions. Viewed from the regions to the right and the left, laterally of the discharge 17, also 90° wide each, the lenses 30 are not active, so that the discharge 17 is visible in its actual location. In the second position, the picture is rotated through 90°, so that now the discharge 17 is directly visible in the regions above and below the discharge, but viewed laterally only through the lenses 30, so that it seems to be shifted.

Figure 3:
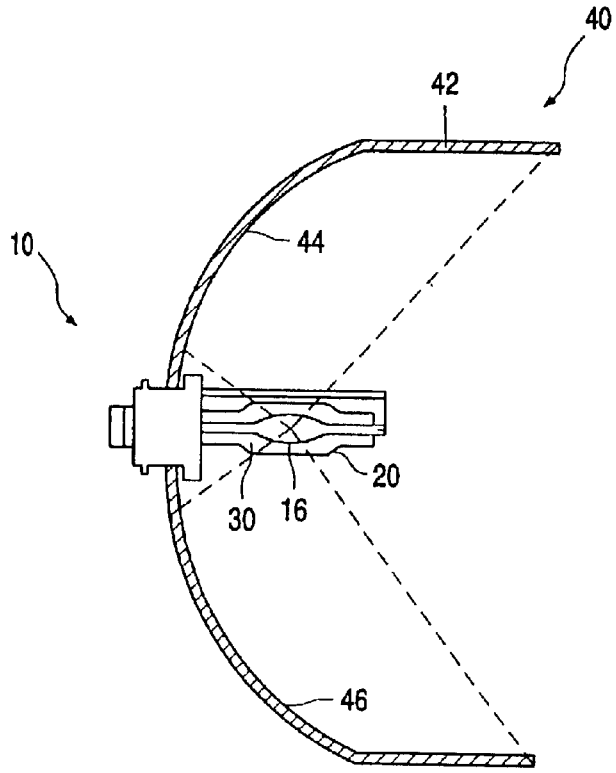
FIG. 3 is a longitudinal sectional view of an embodiment of a headlight according to the invention.

FIG. 3 is a longitudinal sectional view of a first embodiment of a headlight 40. The headlight 40 comprises a reflector 42 as well as the lamp 10 discussed above, which lamp projects through a central opening of the reflector 42 into the interior of the reflector housing, such that the discharge vessel 16 is centrally positioned inside the reflector housing in a previously defined location. For this purpose, the lamp base 12 is accommodated in a holder (not shown) of the reflector housing. The lamp 10 is electrically contacted from this location as well.

The rotary outer bulb 20 with the two lenses 30 is in the first position. A reflector region 44 above and a reflector region 46 below the discharge vessel 16 are not directly illuminated by the discharge in this manner, but instead by an image of this discharge displaced by the lenses 30.

Figure 4:
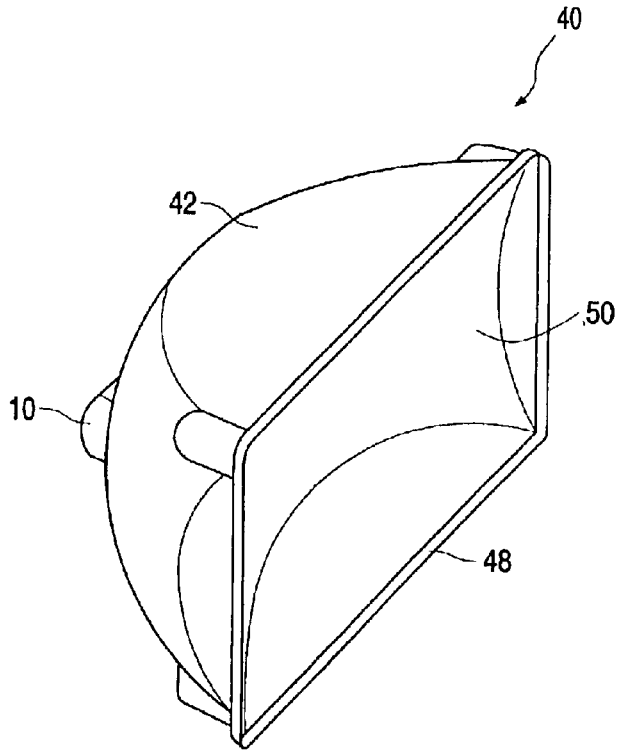
FIG. 4 is a perspective view of the headlight of FIG. 3.

FIG. 4 once more shows the headlight 40 in a perspective view. The reflector 42 has a rectangular frame 48. The inner wall 50 of the reflector is a curved surface. This surface in the example shown, however, is not a parabolic surface, but a specially shaped set of independent surfaces. Such reflector shapes are known to those skilled in the art under the designation "complex shape". Reflector shapes of this kind are calculated by digital methods known to those skilled in the art. The stated object of this is to superimpose and project images of the discharge positioned in a fixed location such that a headlight beam with a desired light distribution is created.

Figure 5:
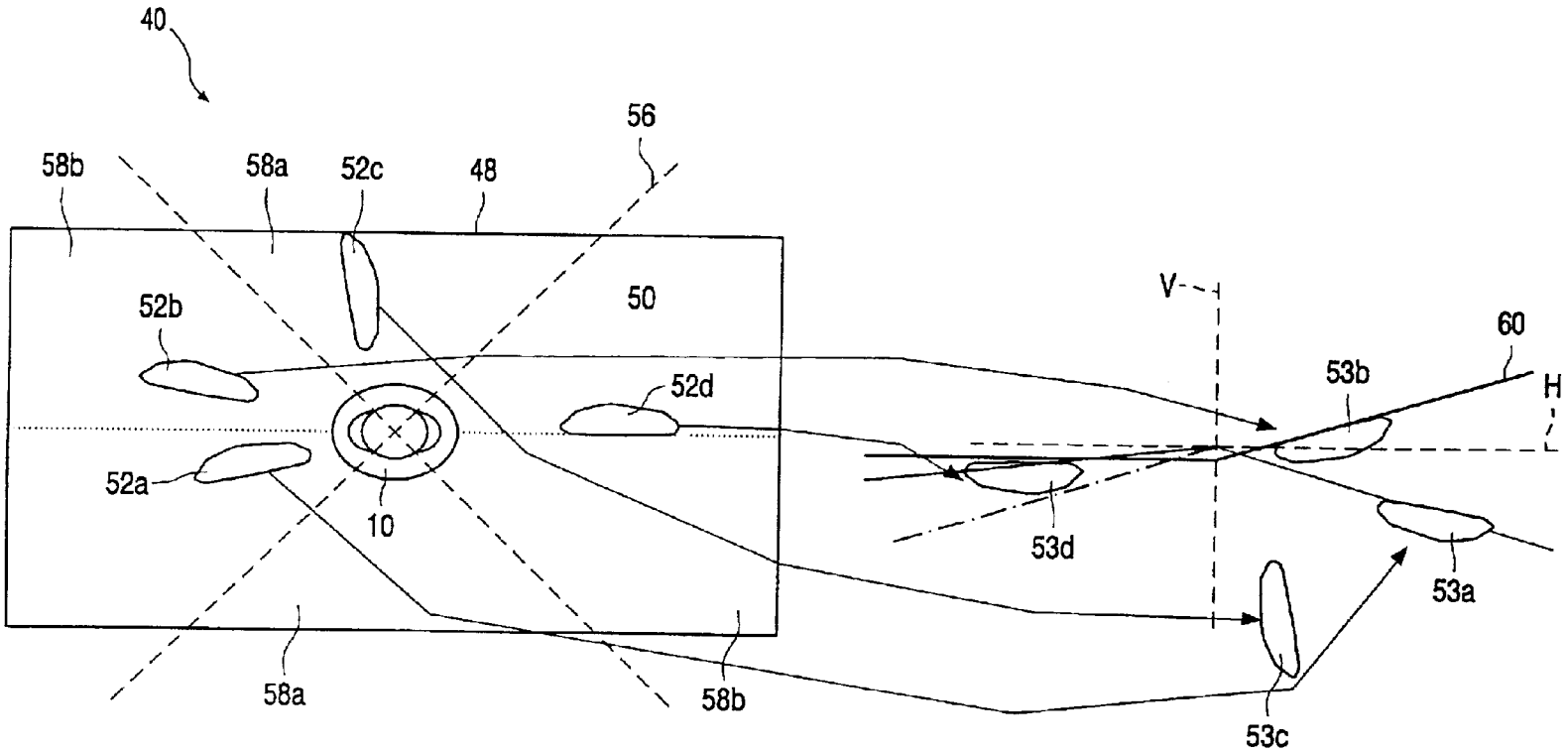
FIG. 5 is a diagram for clarifying the imaging of a discharge on a projection screen.

This is diagrammatically shown in FIG. 5. A front elevation of the headlight 40 with its rectangular frame 48 can be seen on the left-hand side. The lamp 10, indicated symbolically only, is present centrally therein. A number of reflected images 52*a* to 52*d* of the discharge are shown on the reflector surface 50.

A projection screen is shown on the right-hand side of FIG. 5. This is a standardized measuring screen comprising the lines on the basis of which standards for light distributions are defined. The object of the screen is to display the conditions of front illumination of a motor vehicle. The optical axis runs through the point of intersection of the lines H and V, the line H representing the horizon. To exclude any dazzling of oncoming traffic, a low-beam distribution must have a bright/dark cut-off in which a certain minimum illumination is achieved in defined points below a line 60, but no more than a low maximum value above the line 60. This bright/dark cut-off is substantially horizontal, with the line 60 rising in the right-hand half of the screen 15 in the case of right-hand traffic, as is visible in FIG. 5. An image mirrored about the line V is used for left-hand traffic.

The images 52*a* to 52*d* of the discharge on the left-hand side of FIG. 5 are connected to their associated projection locations 53*a* to 53*d* on the projection screens by means of arrows.

It is apparent that the meridional planes of the optical surface 50 of the reflector 42 correspond to the meridional images of the arc in the beam and thus on the measuring screen, and similarly that the sagittal planes correspond to the sagittal images. To realize a beam with a substantially horizontal bright/dark cut-off, accordingly, the substantially horizontal images 53*a*, 53*b*, 53*d* are used in accordance with ECE R8/R20/R98. Vertical images 53*c* are used exclusively for front field illumination. The bright/dark cut-off is given by defined maximum intensities above the line (dazzling) and minimum intensities below the line.

The lateral surfaces 58*b* are much greater than the upper and lower regions 58*a*. The influence of the former on the light distribution is accordingly stronger. In the rectangular shape of the reflector 42 as shown, the total surface area of the regions 58*a* is no more than approximately ¼ of the reflector.

Broken lines 56 shown in FIG. 5 bound those regions in which the lenses 30 are active (the regions 58*b* laterally of the lamp 10 in the second position shown in FIG. 5) and those regions in which the lenses 30 are not active in the second position, i.e. the reflector surfaces 58*a* above and below the lamp 10. As was explained above, the lateral surfaces 58*b* in the reflector discussed here, as in many reflectors used nowadays, are much more important for the light distribution than the upper and lower surfaces 58*a*. The shape of the lateral surfaces 58*b* is exactly calculated, so that the arrangement of a light source in a "focus" leads to an at least approximately symmetrical high-beam light distribution, whereas the arrangement of the light source in a second location shifted in forward direction with respect to the "focus" causes the horizontal images of the discharge along the substantially horizontal bright/dark cut-off of the distribution to be projected on the measuring screen. The term "focus" is in fact not quite correct here, but it is used here also for "complex shape" reflectors, although strictly speaking it is applicable to parabolic reflectors only. The calculation of the shapes of these surfaces is based on an exact positioning of the discharge in each case.

In the second position of the outer bulb shown in FIG. 5, in which the lenses 30 are laterally arranged on the right and on the left, the discharge seems to be in a shifted location when viewed from the lateral reflector region 58*b*. A discharge in this location is reflected by the specially shaped surfaces of the reflector 42 for forming a light beam with a clear bright/dark cut-off, as shown in FIG. 5. The regions 58*a* above and below the lamp, by contrast, are illuminated by the discharge from its actual position. The surfaces are designed such that the vertical images of the discharge are used for front field illumination (region 52*c*, projection 53*c*). A shift of the light source for the vertical projections 53*c* used for front field illumination, however, is without a major influence on the light distribution, given the shape of the reflector shown.

When the outer bulb 20 is rotated into the first position (not shown), however, the lateral regions 58*b* are directly illuminated by the discharge and no longer after passage through the lenses 30. This decisively changes the light distribution. The discharge, now located in the "focus" when viewed from the surfaces 58*b*, generates a high beam of symmetrical distribution in cooperation with the lateral reflector surfaces 58*b*, without the horizontal bright/dark cut-off achieved in the second position.

A switch-over may thus be made between two light distributions, in this example between a low-beam and a high-beam distribution, through an adjustment of the outer bulb 20 between a first and a second position.

The invention may be summarized as follows: a discharge lamp and a headlight for a motor vehicle are proposed. A moving member is provided, which is movable between at least two positions, for switching over between different light distributions. It comprises at least one optically active element, preferably a lens, which generates an image of the gas discharge which is shifted away from the actual location thereof. A switch-over between two different light distributions is made possible by a movement of the moving member between the two positions in the headlight, such that the gas discharge seems to be shifted by the switch-over for a respective region of the reflector, whereby different light distributions are created. Preferably, the moving member is the outer bulb of the discharge lamp, on which two lenses are arranged and which is rotatable about the optical axis.

What is claimed is:

1. A discharge lamp for a motor vehicle with a discharge vessel (16) for generating a gas discharge (17) at an actual location in the discharge vessel (16), wherein at least one moving member (20) is provided at the lamp (10), the moving member (20) comprises at least one optically active element (30) which is designed such that the optically active element (30) generates an image of the gas discharge (17) which is shifted with respect to the actual location of the gas discharge (17), and the moving member (20) is movable into at least two positions.

2. A discharge lamp as claimed in claim 1, wherein the moving member (20) is a sleeve made of a transparent material, which surrounds the discharge vessel (16).

3. A discharge lamp as claimed in claim 2, wherein the moving member is the outer bulb (20) of the discharge lamp (10).

4. A discharge lamp as claimed in claim 1, wherein the moving member (20) is capable of rotation, in particular is arranged with rotation possibility about the optical axis.

5. A discharge lamp as claimed in claim 1, wherein the optically active element is formed by at least one lens (30).

6. A headlight for a motor vehicle with a reflector (42) and a lamp (10) arranged in the reflector (42) for generating a gas discharge (17) at an actual location in a discharge vessel (16), wherein at least one moving member (20) is provided at the lamp (10), the moving member (20) comprises at least one optically active element (30) which is designed such that the optically active element (30) generates an image of the gas discharge (17) which is shifted with respect to the actual location of the gas discharge (17), and the moving member (20) is movable into at least two positions with respect to the lamp (10) and/or the reflector (42), wherein at least one region **(58*b*) of the reflector (42) is directly illuminated by the gas discharge (17) when the moving member (20) is in the first position, and when the moving member (20) is in the second position, said region (58*b*) of the reflector (42) is illuminated by the image of the gas discharge (17) generated by the optically active element (30)**.

7. A headlight as claimed in claim 6, wherein with the moving member (20) in the first position, at least a first region **(58*a*) of the reflector (52) arranged above and/or below the lamp (10) is illuminated by the image of the discharge (17) generated by the optically active element (30), while at least a second region (58*b*) of the reflector (42) arranged laterally of the lamp (10) is directly illuminated by the discharge (17)**.

8. A headlight as claimed in claim 7, wherein with the moving member (20) in the second position, the first region **(58*a*) is directly illuminated by the discharge (17), while the second region (58*b*) is illuminated by the image of the discharge (17) generated by the optically active element (30)**.

9. A headlight as claimed in claim 6, wherein with the moving member (20) in the second position, a light beam with a bright/dark cut-off is generated, and with the moving member (20) in the first position, a light beam without a bright/dark cut-off is generated.

* * * * *